US006598553B1

(12) United States Patent
Hundertmark

(10) Patent No.: US 6,598,553 B1
(45) Date of Patent: Jul. 29, 2003

(54) POWER ASSIST MARINE STEERING SYSTEM

(75) Inventor: James M. Hundertmark, Fond du Lac, WI (US)

(73) Assignee: Mark X Steering Systems, LLC, Oshkosh, WI (US)

( * ) Notice: Subject to any disclaimer, the term of this patent is extended or adjusted under 35 U.S.C. 154(b) by 0 days.

(21) Appl. No.: 10/074,521

(22) Filed: Feb. 13, 2002

(51) Int. Cl.[7] ..... B63H 25/22
(52) U.S. Cl. ..... 114/150; 440/615; 440/61 A
(58) Field of Search ..... 114/150; 440/61, 440/61 R, 61 S, 61 A

(56) References Cited

U.S. PATENT DOCUMENTS

| | | | | |
|---|---|---|---|---|
| 3,587,235 A | * | 6/1971 | Goff et al. | 180/406 |
| 4,432,270 A | * | 2/1984 | Kyster et al. | 60/384 |
| 4,557,676 A | * | 12/1985 | Petersen et al. | 137/625.21 |
| 4,892,494 A | | 1/1990 | Ferguson | |
| 4,976,639 A | | 12/1990 | Rawlings et al. | |
| 5,002,510 A | | 3/1991 | Rump | |
| 5,031,562 A | | 7/1991 | Nakase et al. | |
| 5,057,043 A | | 10/1991 | Sugimoto et al. | |
| 5,072,585 A | * | 12/1991 | Fassbender et al. | 180/441 |
| 5,074,193 A | | 12/1991 | Hundertmark | |
| 5,092,801 A | | 3/1992 | McBeth | |
| 5,104,294 A | | 4/1992 | Banba | |
| 5,127,856 A | | 7/1992 | Kabuto et al. | |
| 5,146,745 A | | 9/1992 | Doetsch | |
| 5,188,051 A | | 2/1993 | Huber | |
| 5,213,527 A | | 5/1993 | Fetchko | |
| 5,240,445 A | | 8/1993 | Aoki et al. | |
| 5,241,894 A | | 9/1993 | Hundertmark | |
| 5,244,426 A | | 9/1993 | Miyashita et al. | |
| 5,349,818 A | | 9/1994 | McFadyen et al. | |
| 5,350,326 A | | 9/1994 | Funami et al. | |
| 5,376,029 A | | 12/1994 | Entringer et al. | |
| 5,387,142 A | | 2/1995 | Takayanagi et al. | |
| 5,409,410 A | | 4/1995 | Bohlin | |
| 5,427,045 A | | 6/1995 | Fetchko | |
| 5,427,556 A | | 6/1995 | Ishikawa et al. | |
| 5,447,456 A | | 9/1995 | Nakayasu | |
| 5,466,178 A | | 11/1995 | Inman, Sr. et al. | |
| 5,481,871 A | | 1/1996 | McFadyen | |
| 5,503,098 A | | 4/1996 | Bohlin | |
| 5,509,369 A | | 4/1996 | Ford et al. | |
| 5,603,279 A | | 2/1997 | Hundertmark et al. | |
| 5,605,109 A | | 2/1997 | Merten et al. | |
| 5,632,217 A | | 5/1997 | Ford et al. | |
| 5,638,679 A | | 6/1997 | Richards | |
| 5,702,275 A | | 12/1997 | Hundertmark | |
| 5,924,379 A | | 7/1999 | Masini et al. | |
| RE36,342 E | | 10/1999 | McFadyen et al. | |
| 5,997,370 A | | 12/1999 | Fetchko et al. | |
| 6,113,444 A | | 9/2000 | Ritger | |
| 6,138,596 A | | 10/2000 | Gonring et al. | |
| 6,148,853 A | | 11/2000 | Wang | |
| 6,164,320 A | | 12/2000 | Hamano et al. | |
| 6,199,498 B1 | | 3/2001 | Hundertmark et al. | |

* cited by examiner

*Primary Examiner*—Sherman Basinger
(74) *Attorney, Agent, or Firm*—Boyle Fredrickson Newholm Stein & Gratz S.C.

(57) ABSTRACT

A power steering assist system for a watercraft includes a hydraulically actuated steering cylinder assembly and a helm. The helm has a high pressure port being coupled to a fluid pressure source, a return port coupled to a reservoir, and a metering port coupled to a second chamber of the steering cylinder. A control valve assembly in the helm is switchable between at least first and second states to alternatively couple a metering element in the helm to the high pressure and return ports of the helm, respectively, hence alternatively permitting pressurized fluid to flow into the metering port from the metering element to steer the watercraft in a first direction and from the metering port into the metering element to steer the watercraft in a second direction. The system is simple, compact, reliable, and still usable in watercraft having multiple engines and/or multiple helms.

22 Claims, 7 Drawing Sheets

POWER ASSIST MARINE STEERING SYSTEM

BACKGROUND OF THE INVENTION

1. Field of the Invention

The invention relates to marine steering systems and, more particularly, relates to a power assist steering system for a boat or other watercraft. Specifically, the invention relates to a steering system that incorporates an operator controlled helm and a separate hydraulic steering cylinder that is controlled by the helm in a master/slave fashion to steer the watercraft.

2. Discussion of the Related Art

In a conventional marine steering system, a watercraft such as a boat is steered by pivoting a rudder and/or outboard motor on the stern of the watercraft about a vertical steering axis upon steering actuation by an operator stationed at the helm. One typical steering system for a boat having a hull-mounted motor comprises a steering cable extending between the steering helm and the motor so that steering at the helm actuates the cable to pivot the motor about the steering axis. The cable typically comprises a push-pull cable having a reciprocatable inner core slidable in a protective, flexible outer sheath or housing. One end of the cable is connected to the steering helm, and the other end is connected to a tiller arm coupled to the motor or rudder. When the wheel is turned at the helm, the cable is actuated by a push-pull movement of the inner core, thereby pivoting the tiller arm. These systems work reasonably well on small boats, but the steering forces required for pivoting the tiller arm increase progressively with system size to the point that many larger boats can be steered manually only with great difficulty, if at all.

In order to reduce the forces required to steer a watercraft, it is well-known with marine outboard drives, particularly those employing large displacements, to employ a hydraulic power steering assist system for assisting the operator in steering the boat. The typical hydraulic power steering assist system includes a hydraulic cylinder that is connected to a tiller arm or other steered mechanism and that is energized in response to operator control to actuate the steered mechanism. Specifically, a helm-responsive controller is coupled to a hydraulic cylinder assembly that, in turn, is coupled to the steered mechanism, either directly or via an intervening push-pull cable. When the steering wheel is turned one way or the other, hydraulic fluid is pumped from the steering helm to one end or the other of the cylinder assembly to pivot the motor one way or the other.

A power steering assist system that is generally of the type described above is described in U.S. Pat. No. 5,603,279 (the '279 patent). The system described in the '279 patent comprises a hydraulic cylinder-piston assembly and a helm. The cylinder-piston assembly has a reciprocally mounted piston and first and second chambers in the cylinder on opposite sides of the piston. The steering cylinder has a balanced piston. In fact, as with most systems of this general type, a rod extends through both ends of the steering cylinder making for a longer assembly. The helm includes two separate cylinder assemblies that are divided into four separate internal chambers by a stepped flanged piston. One of the cylinder assemblies forms a master cylinder that is actuated directly by a control valve assembly under power supplied from the pressure source. The portion of the piston in this part of the assembly is stepped so as to form an unbalanced cylinder in the helm. The second cylinder assembly comprises a slave cylinder divided into third and fourth chambers by an annular flange on an extension of the piston. The third and fourth chambers are coupled to respective chambers of a steering cylinder. The control valve assembly is actuatable to regulate the flow of hydraulic fluid into and out of the second chamber to drive the piston and, thereby, vary the volumes of the third and fourth chambers and driving the steering piston one way or the other within the steering cylinder to effect a steering operation. The actuator of the valve assembly comprises a rotatable valve body that has first and second valves mounted in it. A rotatable input member (e.g., a steering shaft or extension thereof), actuable upon steering at the helm, is operably connected to the valve actuator. Thus, steering at the helm actuates the valve actuator to regulate the flow of pressurized hydraulic fluid through the cylinder, thereby driving the piston in one direction or the other depending upon the steering direction.

The system disclosed in the '279 patent, while effective, exhibits several drawbacks and disadvantages. For instance, because its helm has four chambers and, in effect, two pistons, it requires a great many seals. The helm is also relatively large (both axially and radially). In fact, it is so large that it must be formed from a casting rather than machined components. It is therefore difficult to mount on the back of the dashes of many smaller boats. Several of the hydraulic fittings on the helm also are necessarily located on the periphery of the helm rather than on the rear end, rendering it difficult to access those fittings after the helm is installed behind the dash.

Moreover, in the system disclosed in the '279 patent, only part of the system (namely, the first and second chambers of the helm) is pressurized directly by the pressure source. The remainder of the system (namely, the third and fourth chambers of the helm and both chambers of the steering cylinder) is pressurized indirectly via translation of the slave portion of the piston. Air in the lines of that portion of the system can lead to noticeable "looseness" or play of the cylinders.

Many of the problems associated with the '279 patent were addressed and overcome in co-pending and commonly assigned application Ser. No. 09/967,792 (the '792 application), filed Sep. 28, 2001, now U.S. Pat. No. 6,524,147 The system disclosed in the '792 application includes a hydraulically actuated unbalanced steering cylinder assembly, a pressure source, and a helm that is spaced from the steering wheel assembly, typically within the dash. The helm includes a helm cylinder having a slave chamber fluidically coupled to a second chamber in the steering cylinder, a high pressure port fluidically coupled to the outlet of the pressure source and to a first chamber in the steering cylinder, and a return port fluidically coupled to a vent. A helm piston is slidably mounted in the helm cylinder, and a control valve assembly is movable between at least first and second positions to alternatively couple a control chamber in the helm cylinder to the high pressure and return ports, respectively. The resultant system is considerably simpler and more compact than that disclosed in the '279 patent. It also is pressurized directly by a single source and, therefore, does not exhibit the looseness experienced by some other systems. In fact, it is extremely well configured for use in a relatively small, single engine watercraft. However, it is not easily adaptable to a multiengine watercraft having a separate steering cylinder for each rudder. It also is not usable with watercrafts having multiple helms.

SUMMARY OF THE INVENTION

In accordance with a first aspect of the invention, a power steering assist system for a watercraft includes a hydraulically actuated steering cylinder assembly and a helm. The steering cylinder assembly is configured for connection to a steered mechanism of the watercraft. It includes a steering cylinder, a steering piston that is mounted in the steering cylinder to define first and second chambers on opposite sides thereof, and a rod that is affixed to the steering piston. Either rod or the steering cylinder is movable relative to the other and is configured for connection to the steered mechanism. The helm, which is spaced from the steering cylinder assembly, has high pressure, return, and metering ports formed therein. The high pressure port is coupled to a fluid pressure source, the return port is coupled to a reservoir, and the metering port is coupled to the second chamber of the steering cylinder. The helm includes a metering element having at least first and second ports, the second port being coupled to the metering port in the helm, and a control valve assembly that is coupled to the metering element and that is switchable between at least first and second states to alternatively couple the first port in the metering element to the high pressure and return ports of the helm, respectively, thereby alternatively permitting pressurized fluid to flow into the metering port from the metering element and from the metering port into the metering element. The control valve assembly may also be switchable to a third, neutral state in which the first port of the metering element is isolated from both of the high pressure and return ports.

In a preferred embodiment, the control valve assembly comprises first and second two-way/two-position valves that are configured to be actuated by an operator manipulated steering mechanism (such as steering wheel) such that 1) both the first and second valves remain closed when the steering mechanism remains stationary, 2) movement of the steering mechanism in a first direction opens the first valve while leaving the second valve closed, and 3) movement of the steering mechanism in a second direction opens the second valve while leaving the first valve closed. In this case the control valve assembly preferably comprises a valve actuator and a valve body, the valve body 1) being rotatably coupled to the metering element and to the steering mechanism, 2) housing the first and second valves, 3) having a first passage formed therein that couples the high pressure port to the first port of the metering element, and 4) having a second passage formed therein that couples the first port of the metering element to the return port. The valve actuator is movable relative to the valve body between first, second, and third positions thereof corresponding to the first, second, and third states of the valve assembly.

The system preferably additionally includes a relief valve assembly that allows the system to be operated manually in the event of pressure source failure. The relief valve assembly may include a two-way/two-position pilot-operated valve that allows manual operation of the system if the pressure source is inoperative. Due at least in part to the incorporation of the relief valve assembly into the system, the metering element is coupled to the control valve assembly such that the metering element is rotated manually by the control valve assembly so as to act as a pump in the event of pressure source failure.

In accordance with another aspect of the invention, a method of steering a watercraft includes placing a pressure source in fluid communication with a high pressure port of a helm casing of a helm and a first chamber in a hydraulic steering cylinder located remote from the helm casing, the first chamber being separated from a second chamber by a steering piston, and a driven member being formed by one of the steering cylinder and the rod and being coupled to a steered mechanism of the watercraft. Then, in response to movement of a steering mechanism of the watercraft in a first direction from an at-rest position thereof, the system causes a metering element in the helm casing to rotate in a first direction and deliver fluid to the second chamber in the steering cylinder, thereby causing the driven member to move in a first direction. Conversely, in response to movement of the steering mechanism in a second direction from the neutral position, the system causes the metering element to rotate in a second direction to permit hydraulic fluid to flow into the metering element from the second chamber in the steering cylinder, thereby causing the driven member to move in a second direction opposite the first direction.

In a preferred embodiment, the metering element has a first port and has a second port in fluid communication with the second chamber in the steering cylinder. In this system, when the steering mechanism is in the at-rest position, a control valve assembly of the helm is switched to a first state isolating the first port of the metering element from the pressure source and from vent. When the steering mechanism moves in the first direction from the at-rest position, the control valve assembly switches to a second state fluidically coupling the first port in the metering element to the pressure source. Conversely, when the steering mechanism moves in the second direction, the valve assembly switches to a third position fluidically coupling the first port in the metering element to vent.

In order to facilitate mounting of the helm to the dash of the watercraft, the helm has only three ports (namely, a slave port that is fluidically connected to the second chamber in the steering cylinder, the high pressure port, and the return port), and all three ports are all located on a rear axial end of the helm cylinder. The helm cylinder also is very compact.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
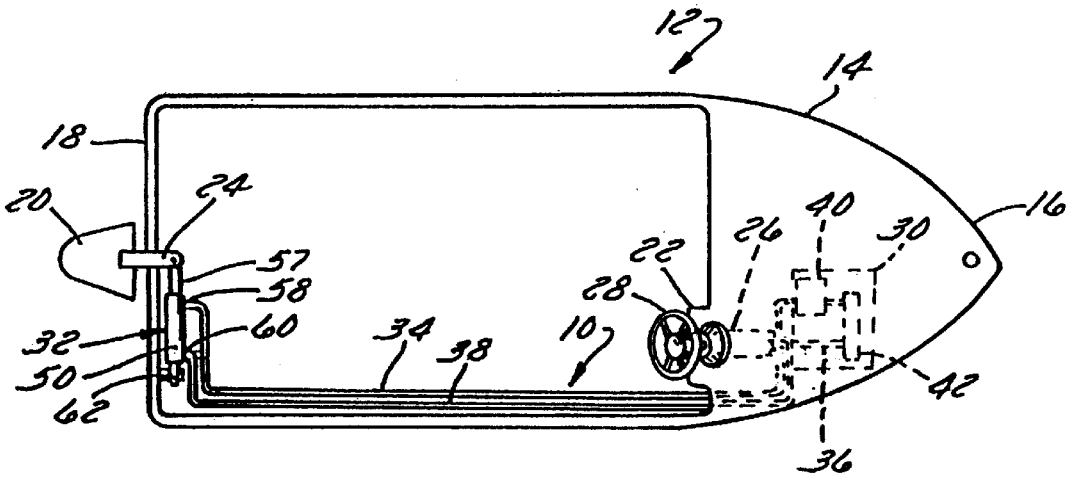
FIG. 1 is a schematic top plan view of a boat incorporating a power steering assist system constructed in accordance with a preferred embodiment of the present invention.

Turning now to the drawings and initially to FIG. 1, a boat 12 incorporates a power steering assist system 10 (hereafter simply "power steering system") constructed in accordance with a preferred embodiment of the present invention. The boat 12 includes a hull 14 having a bow 16 and a stern 18, an outboard motor 20 mounted on the stern 18, and a cowling or dash 22 extending laterally across the hull 14 near the bow 16. As is conventional, the motor 20 is mounted on the boat 12 by a pivoting mount assembly (not shown) that permits the motor 20 to be pivoted about a vertical axis to cause a rudder formed on or by the motor 20 to steer the boat 12. The motor 20 could alternatively be a non-pivoting inboard or outboard motor, and the boat 12 could be steered by one or more rudders movable separately from the motor 20.

Figure 2:
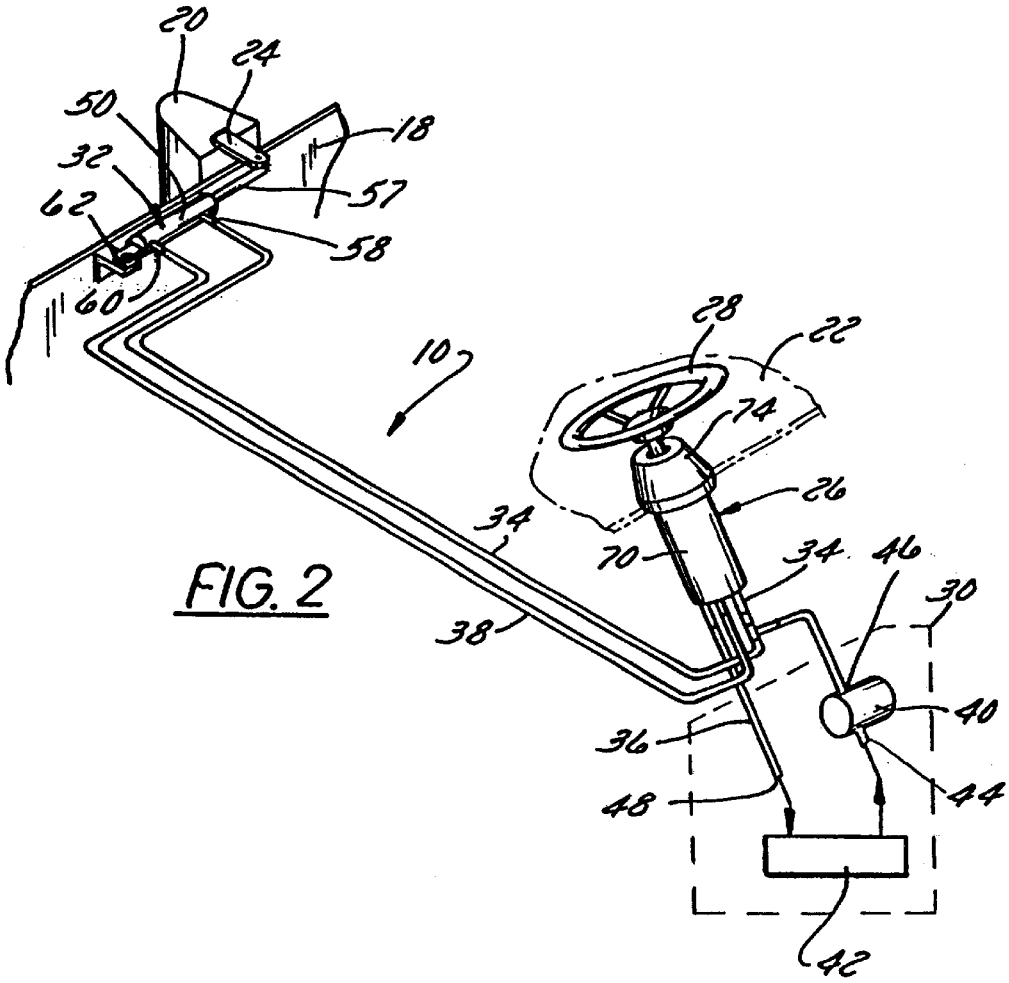
FIG. 2 is somewhat schematic perspective view of the power steering assist system of FIG. 1.

Referring now to FIGS. 1–2, the steering system 10 for the boat 12 includes a tiller arm 24 coupled to the motor 20 and forming the boat's steered mechanism, a helm 26 including a steering wheel 28 serving as the boat's steering mechanism, a pressure source 30, and a steering cylinder assembly 32. The present embodiment contains no mechanical linkage connecting the helm 26 to the steering cylinder assembly 32. Both assemblies 26 and 32 are pressurized by a single power source. The helm 26 is mounted through the dash 22 and is actuated by the steering wheel 28. The steering cylinder assembly 32 is actuated by the helm 26 to move the tiller arm 24 and pivot the motor 20 on its mount under power supplied by the pressure source 30. In order to minimize the size and weight of the components that are mounted behind the dash 22, the steering cylinder assembly 32 is located remote from the helm 26, possibly adjacent the motor 20 as illustrated, or on the motor, so as to be connectable directly to the tiller arm 24. Alternatively, the steering cylinder assembly 32 could be mounted at some other location on the boat 12 and connected to the tiller arm 24 by a push-pull cable or the like. Multiple steering cylinders could be provided in a multiple engine watercraft and connected to the helm 26 in a parallel fashion. The helm 26 is connected to the pressure source 30 by a high pressure line 34 and a return line 36. It is also connected to the steering cylinder assembly 32 by the high pressure line 34 and a slave line 38.

The fluid pressure source 30 could comprise any structure or assembly capable of generating hydraulic pressure and of transmitting it to the helm 26 and the steering cylinder assembly 32. It also can be located virtually anywhere on the boat 12. In the illustrated embodiment, the fluid pressure source 30 includes a pump 40 and a reservoir 42, best seen in the assembly illustrated in FIG. 2. The pump 40 has an inlet 44 connected to an outlet of the reservoir 42 and has an outlet 46 connected to or, as in the illustrated embodiment, forming the pressurized outlet of the pump assembly 30. An accumulator (not shown) could be provided between the pump outlet 46 and the helm 26, if desired. The reservoir 42 has an inlet 48 connected to or, as in the illustrated embodiment, forming the unpressurized inlet of the pressure source 30.

Referring to FIGS. 2, 4, 5, and 6 the steering cylinder assembly 32 comprises a hydraulically actuated, unbalanced steering cylinder assembly operatively coupled to the helm 26, the pump outlet 46, and the tiller arm 24. "Unbalanced" as used herein means that the cylinder assembly's piston has different effective surface areas on opposite sides thereof such that equal fluid pressures on both sides of the piston generate an intensification effect on the side of the piston having a greater effective surface area and drive the piston to move towards the side of the cylinder facing the side of the piston having a smaller effective surface area. The steering cylinder assembly 32 includes a steering cylinder 50, a steering piston 52 mounted in the steering cylinder to form first and second chambers 54, 56 on opposite sides of the steering piston 52, and a rod 57 connected to the steering piston 52. A first port 58 opens into the first chamber 54 for connection to the high pressure line 34 in a check valve 59. A second port 60 opens into the second chamber 56 for connecting to the metering line 38. The steering cylinder 50 of this embodiment is stationary and is mounted on the stern 18 of the hull 14 by a suitable bracket 62. The rod 57 extends axially through a rod end 64 of the steering cylinder 50 (disposed opposite a cylinder end 66) and terminates at a free end that is coupled to the tiller arm 24. The unbalanced condition of the assembly 32 therefore is created by virtue of the attachment of the rod 57 to the steering piston 52 and the consequent reduction in piston surface area exposed to fluid pressure in the first chamber 54. Alternatively, the rod 57 could extend completely through the steering cylinder 50 and could be affixed to a stationary support, in which case the steering cylinder 50 would be coupled to the tiller arm 24 and would reciprocate relative to the stationary piston 52. In this case, the unbalanced condition of the assembly 32 would be achieved by other measures, e.g., by making one end of the steering rod 57 diametrically smaller than the other.

Figure 3:
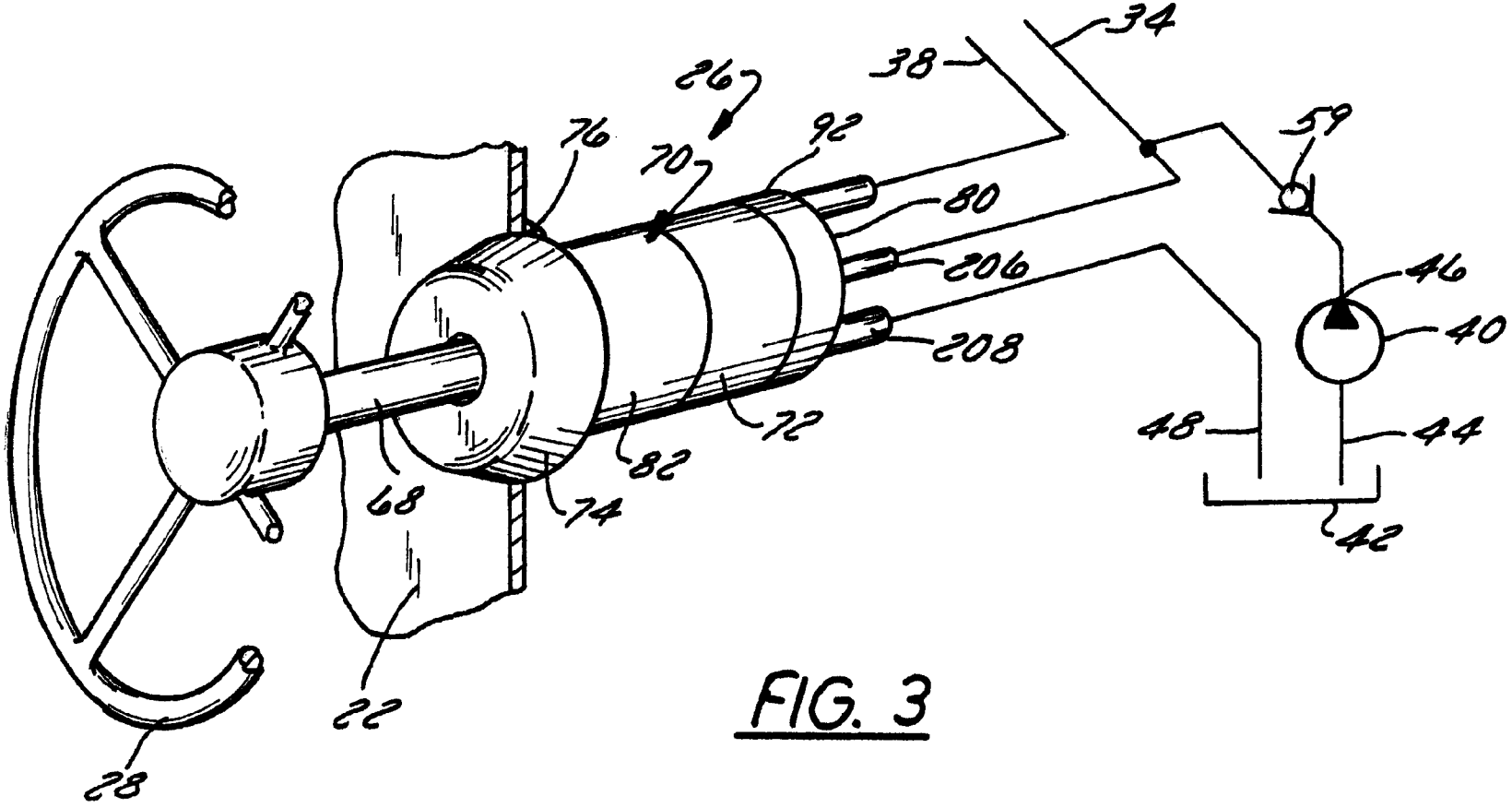
FIG. 3 is an elevation view of a portion of a dash of the boat of FIG. 1, showing a steering wheel and a helm of the power steering assist system mounted on the dash.

Referring to FIG. 3, the helm 26 is mounted through the dash 22. It includes the steering wheel 28, a steering shaft 68 extending forwardly from the dash 22, and a helm casing 70 located behind the dash 22. The helm casing 70 is relatively compact, having a body 72 and a cap 74 screwed onto the front end of the body 72. The back end of the cap 74 is mounted on the front surface of the dash 22 by bolts 76. The body 72 is cylindrical, having a rear axial end 78 (FIG. 5), a front axial end 80, and an outer radial periphery 82. It is very narrow, having a diameter of no more than 3¼". The body 72 also is relatively short, having a total length of no more than about 3" to 3½". The entire helm casing 70, including the body 72 and the cap 74, is no longer than 6" to 7". Mounting behind the dash 22 is facilitated by the fact that the helm casing 70 has only a limited number of fittings (three in the preferred embodiment), and all of those fittings extend from the relatively easily-accessible rear axial end 80 of the helm casing 70. The helm 26 therefore is considerably smaller than the helm disclosed in the '279 patent and easier to mount to the dash. It is also considerably lighter, weighing 6 to 7 pounds less than the commercial version of the helm disclosed in the '279 patent. The helm cylinder also need not be formed from a casting.

The hydraulic circuitry contained within the pressure source 30, the helm 26, and the steering cylinder assembly 32 will now be described with reference to FIG. 4. The helm casing 70 has a high pressure port 84 connected to the high pressure line 34, a metering port 86 connected to the metering line 38, and a return port 88 connected to the return line 36. Located within the helm casing 70 (FIG. 3) are a valve body 90 having a control valve assembly, a metering device 92, and a relief valve assembly including a relief valve 186, a pilot-operated valve 188, and a make-up valve 196. A control chamber 100 is formed in helm casing 70 (FIG. 3) between the metering device 92 and the valve body 90.

The control valve assembly includes first and second normally closed two-way/two-position valves. Still referring to FIG. 4, the first valve is a supply valve 102 having an inlet port 104 coupled to the high pressure port 84 and having an output port 106 coupled to the control chamber 100. The second valve is a return valve 108 having an inlet port 110 coupled to the control chamber 100 and an outlet port 112 connected to the return port 88 via the valves 186 and 196. Both valves 102 and 108 are coupled to a common actuator 114 (preferably one acted upon by the steering shaft 68 (FIG. 3)), such that movement of the actuator in a first direction opens one of the valves 102 or 108 while leaving the other valve closed, and movement of the actuator in a second direction opens the other valve 108 or 102 while leaving the one valve closed. A suitable actuator is described below in conjunction with FIG. 5.

It can thus be seen that the first chamber 54 of the steering cylinder 50 will always be at a pressure P1 that is the same pressure as the pump outlet pressure. The control chamber 100 of the helm casing 70 (FIG. 3) and the second chamber 56 of the steering cylinder 50 will all be at a second pressure P2 when no load is applied to the rod 57. The pressure P2 will, depending upon the operational state of the valve assembly and the direction of load applied to rod 57, vary from a low of essentially 0 psi relative to the atmosphere to a high of P1 (typically on the order of 1000 psi).

Figure 4:
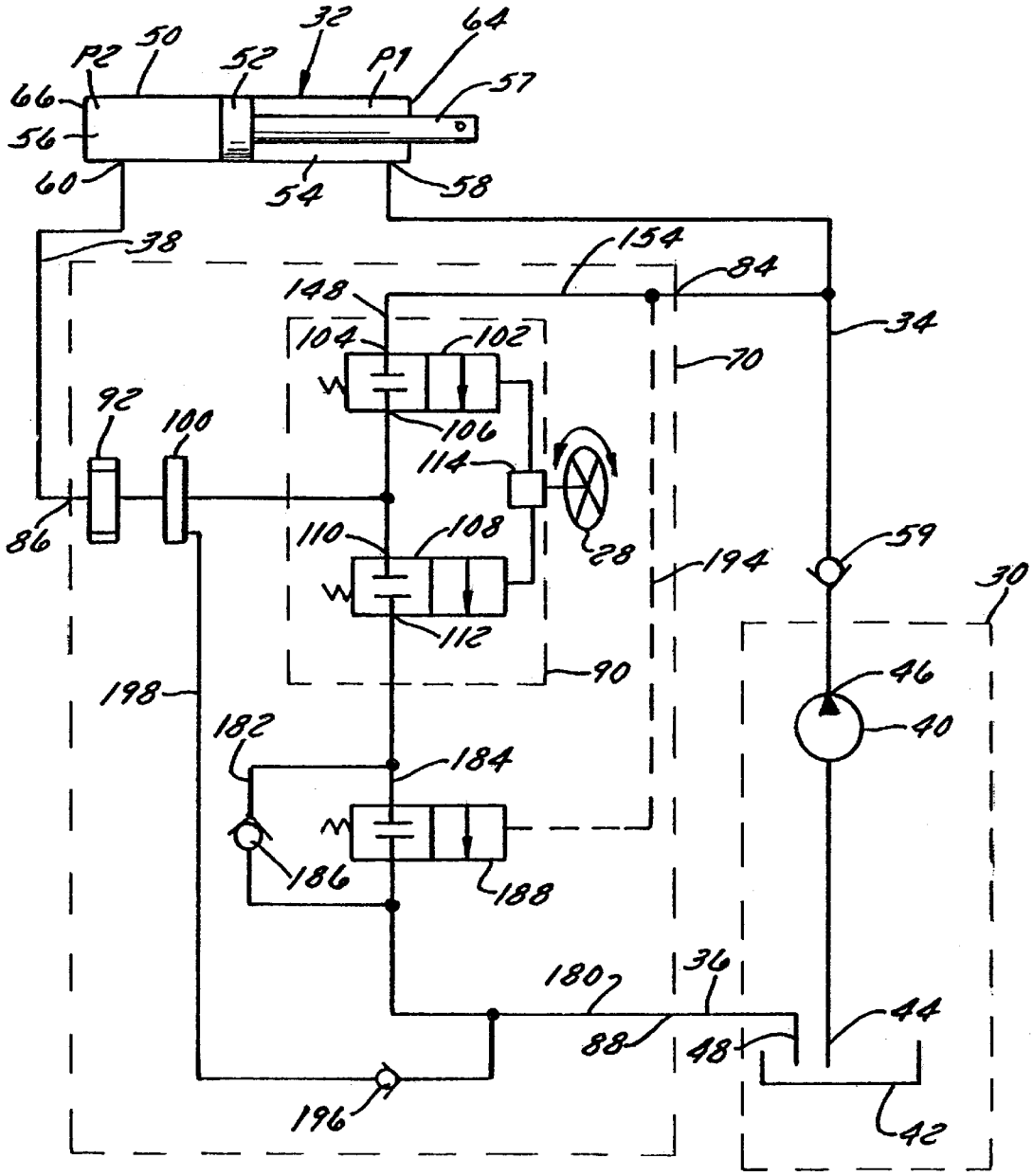
FIG. 4 is a hydraulic circuit schematic of the power steering assist system.
Figure 5:
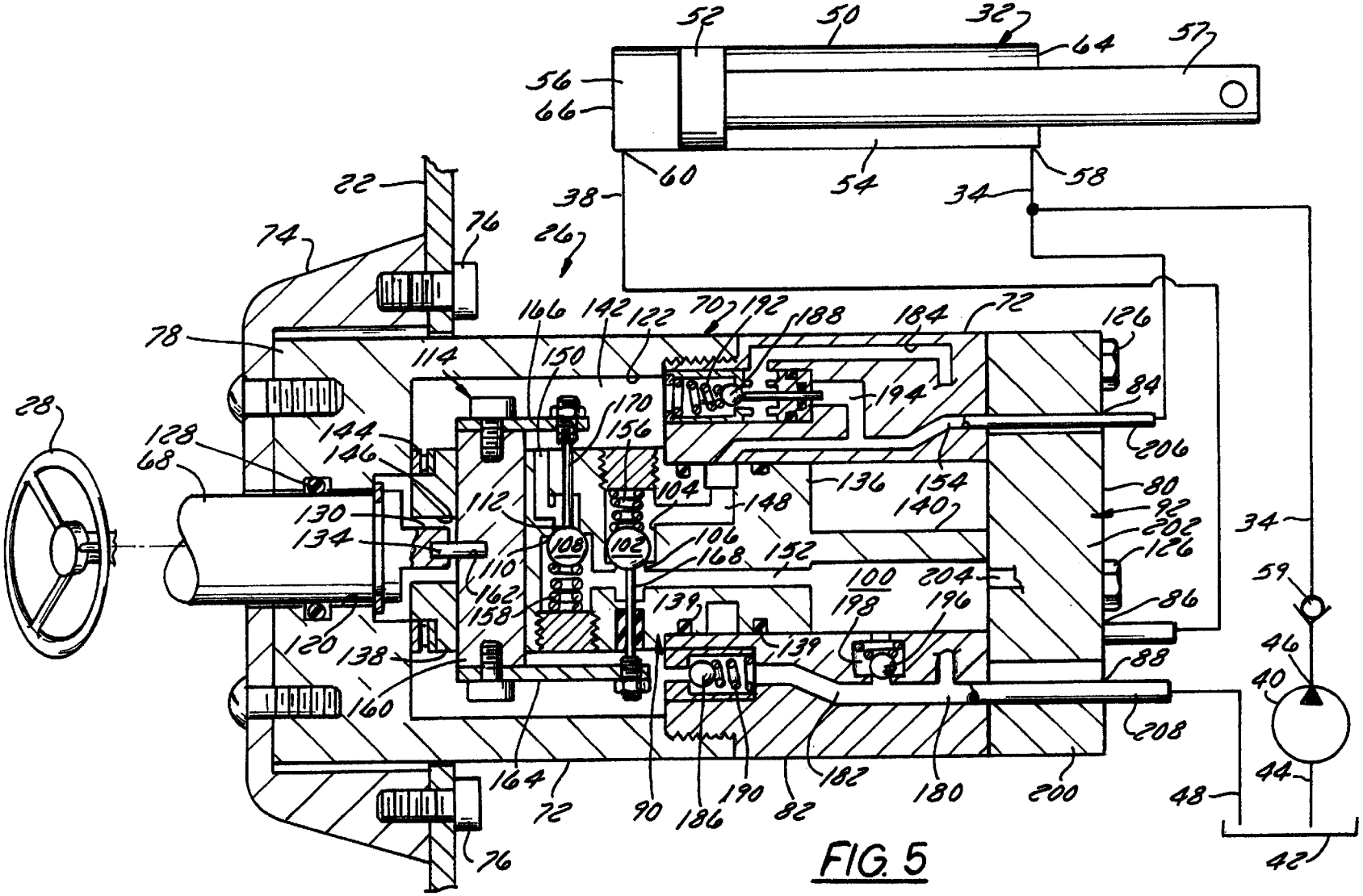
FIG. 5 is a side sectional elevation view of the power steering assist system, illustrating the system in a first operational state thereof.

Referring now to FIG. 5, the physical structure of a helm assembly incorporating the hydraulics of FIG. 4 can be seen to include a helm casing 70 that supports, from rear to front end, the steering shaft 68, the valve actuator 114, the valve body 90, and the metering device 92. The steering shaft 68 protrudes outwardly from an opening 120 in the rear end 78 of the casing 70. The valve actuator 114 and valve body 90 are housed in an interior chamber 122 of the casing 70. The front end 80 of the helm casing 70 is formed from a casing 200 of the metering device 92, which is attached to the remainder of the helm casing 70 by bolts 126. The valve body 90 is coupled to a rotary input (not shown) of the metering device 92 so that the metering element and valve body rotate together as a unit.

Figure 6:
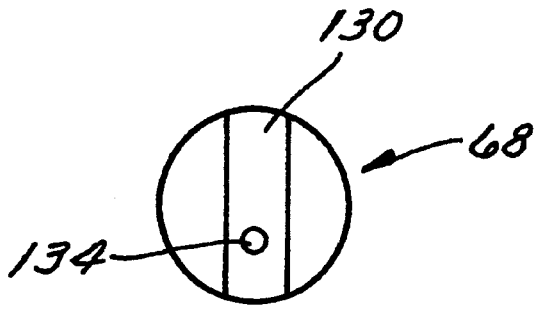
FIG. 6 is an end elevation view of a front end of a steering cylinder of the system.

Referring to FIGS. 5 and 6, the steering shaft 68 is sealed to the opening 120 via an O-ring seal 128. The front end of the steering shaft 68 is stepped to present a rectangular protrusion 130. An actuator pin 134 extends forwardly from the protrusion 130 and into the valve actuator 114. As best seen in FIG. 6, the actuator pin 134 is located eccentrically on the protrusion 130 so as to revolve about the axis of rotation of the steering shaft 68 upon steering shaft rotation, thereby driving the actuator 114 to move radially relative to the valve body 90 when the steering shaft 68 rotates relative to the valve body 90.

Figure 7:
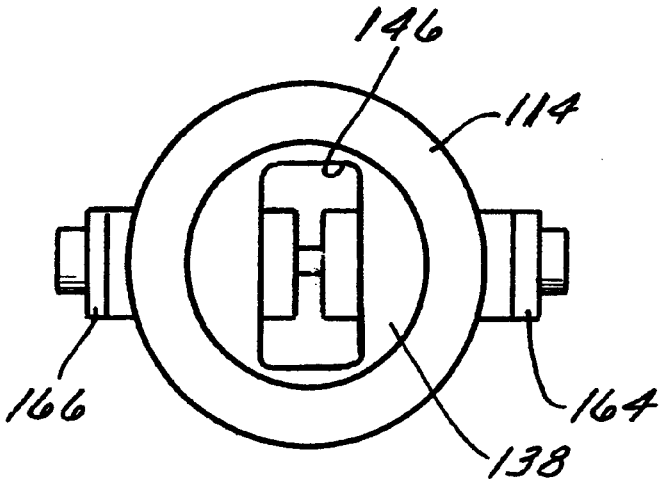
FIG. 7 is an end elevation view of a rear end of a valve assembly of the system.

Referring to FIGS. 5 and 7, the valve body 90 comprises a tubular metal structure having a body portion 136, a rear end 138, and a front shaft portion 140. The body portion 136 is sealed against an inner surface of the helm casing 70 by O-rings 139 to form (1) a vent chamber 142 in front of the valve body 90 and (2) the control chamber 100 between the valve body 90 and the metering device 92. The rear end cap 138 is rotatably bound in the helm casing 70 by a thrust bearing 144. The thrust bearing 144 bears the load imposed on the system by pressure in the control chamber 100. The end cap 138 also has a rectangular central opening 146 formed in it that receives the protrusion 130 on the end of the steering shaft 68 in a manner that permits limited relative rotational movement between the protrusion 130 and the periphery of the opening 146. Finally, the shaft portion 140 extends forwardly from the front end of the body portion 136 and is connected to the metering device 92 such that the valve body 90 and the operated component (metering element 202) of the metering device 92 rotate as a unit. Still referring to FIG. 5, the supply and return valves 102 and 108 are housed in cross-bores formed in the rear end of the body portion 136 of the valve body 90. The valves 102 and 108 cooperate with supply and vent passages 148 and 150 in the body portion 136 so as to permit a control passage 152 in the body portion 136 to be selectively connected the high pressure port 84 and to the vent chamber 142 by suitable switching of the valves 102 and 108. Specifically, the supply passage 148 has an helm coupled to the high pressure port 84 of the valve casing 70 by an inlet passage 154 extending through the metering device 92 and has an outlet coupled to the inlet 104 of the supply valve 102. The vent passage 150 has an inlet communicating with the outlet 112 of the return valve 108 and an outlet opening into the vent chamber 142. The control passage 152 extends axially from the control chamber 100 to the valve assembly in fluid communication with the outlet 106 of the supply valve 102 and the inlet 110 of the return valve 108.

Still referring to FIG. 5, the supply valve 102 seats toward one end of the supply passage 148. It includes a ball-type valve element biased towards its seat by a spring 156. Conversely, the return valve 108 seats towards the other side of the vent passage 150. It also includes a ball valve element biased toward its seat by a spring 158.

The valve actuator 114 is coupled to the steering shaft 68 so as to move radially through a limited stroke with respect to the valve body 90 upon relative rotational movement between the steering shaft 68 and the valve body 90. Specifically, with reference to FIGS. 5 and 7, the valve actuator 114 comprises a shaft 160 mounted in the rear end of the body portion 136 of the valve body 90. A slot 162 is cut in the center of the shaft 160 for receiving the actuator pin 134. In addition, first and second actuator support tabs 164 and 166 are bolted to opposed peripheral surfaces of the shaft 160 and extend forwardly from the front end of the shaft 160. First and second actuator pins 168 and 170 are threaded into bores in the respective tabs 164 and 166. The bases of the pins 168 and 170 are spaced from one another by a distance that is greater than the diameter of the valve body 90, thereby forming a radial clearance between each of the bases and the outer periphery of the valve body 90 when the valves 102 and 108 are closed. This arrangement permits adjustment of the at-rest clearance of the actuator pins 168 and 170 and the stroke of the pins. Hence, when the valve actuator 114 moves radially relative to the valve body 90 in a first direction, the pin 168 engages the ball-type valve element forming the supply valve 102 to open the supply valve (compare FIG. 5 to FIG. 8). Similarly, when the valve actuator 114 moves relative to the valve body in the second direction, the pin 170 engages the ball-type valve element forming the return valve 108 to open the return valve (compare FIG. 5 and FIG. 9).

Still referring to FIG. 5, the vent chamber 142 is connected to the return port 88 in the valve casing by a drain passage 180 extending generally axially through the outer portion of the helm casing 70. The drain passage 180 includes first and second branches 182 and 184 having first and second valves 186 and 188 mounted therein. Each of the valves 186 and 188 is biased into its closed position by a respective return spring 190, 192. The valve 186 is a spring-loaded relief valve. The valve 188 is a pilot actuated valve that normally held in its open position by fluid pressure in a branch 194 of the inlet passage 154 so as to permit unrestricted flow into the branch 184 of the drain passage 180 from the vent chamber 142. However, upon pump failure, the valve 188 closes under the force of the biasing spring 192 so as to isolate the vent chamber 142 from the drain passage 180, whereupon the vent chamber 142 drains to the reservoir 42 only when the pressure therein rises to a pressure high enough to overcome the biasing force of the spring 190 and open the relief valve 186. Finally, make-up fluid for manual operation is provided via a spring loaded check valve 196 located in a make-up passage 198 extending from the drain passage 180 to the control chamber 100.

The metering device 92 may comprise any commercially available metering pump. Still referring to FIG. 5, a suitable metering device includes a stationary annular casing 200 forming the rear end of the helm casing 70 and a central rotatable metering element 202 coupled to the shaft portion 140 of the valve body 90. A first port 204 of the metering element 202 opens into the control chamber 100. Passages 206 and 208 are formed axially through the casing 200 for receiving tubular extensions of the inlet passage 154 and drain passage 180, respectively. The metering element 202 typically (but not necessarily) will comprise a so-called metering gear. Depending on the operational status of the system, the metering device 92 may operate as a valve (controlling fluid flow between the control chamber 100 and the metering port 86) or as a pump (pumping fluid to or from the metering port 86). A metering device having these characteristics is available, e.g., from Eaton Corporation, under the brand name Char-Lynn.

Figure 8:
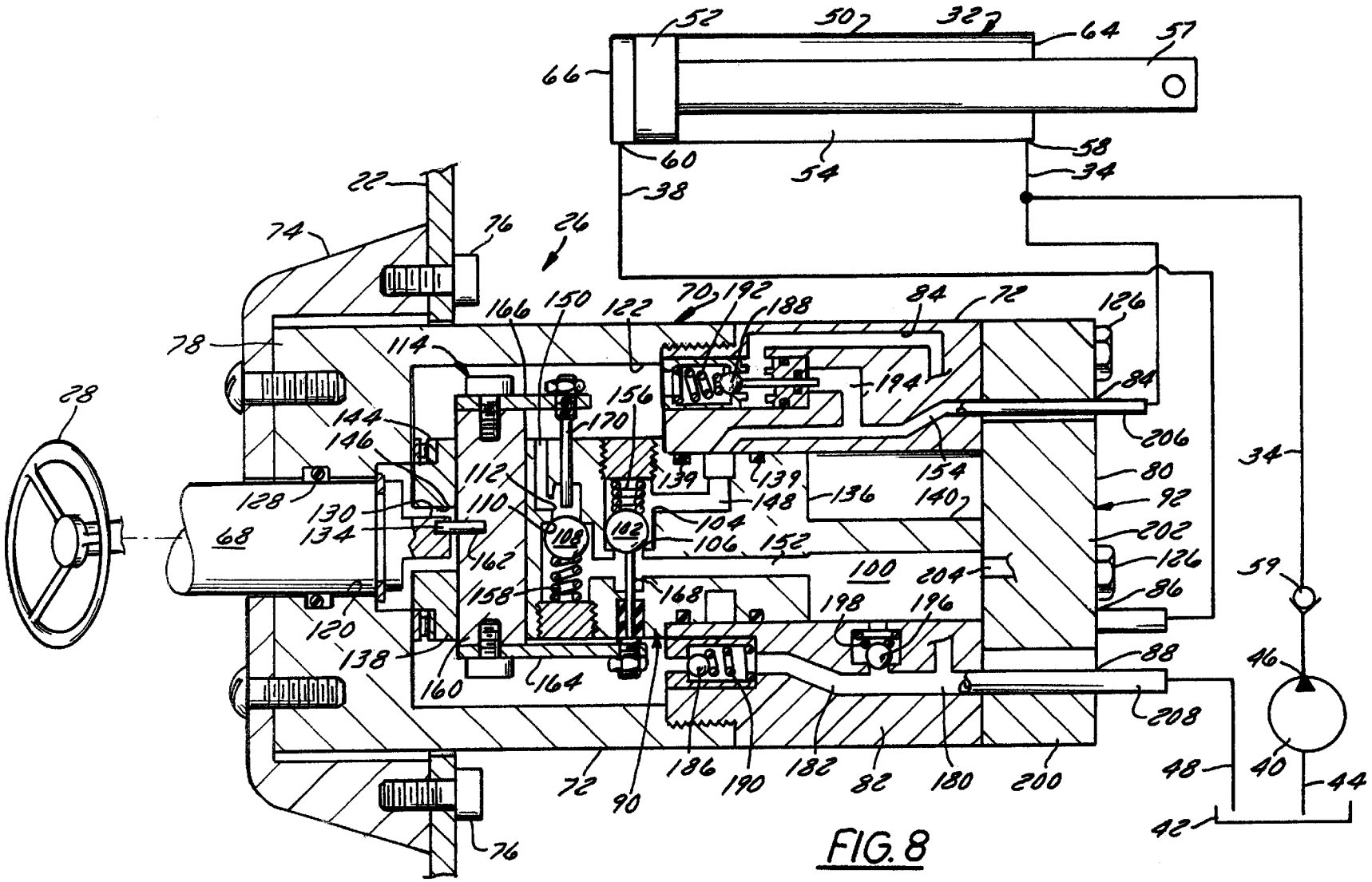
FIG. 8 corresponds to FIG. 5 and illustrates the system in a second operational state thereof.

The operation of the power assist steering system will now be described with the assumption that the components are in the position illustrated in FIG. 5 and the steering wheel 28 and steering shaft 68 are stationary. The valve actuator 114 is balanced with respect to the valve body 90 at this time, and both the supply and return valves 102 and 108 are closed to block flow into or out of the control chamber 100. Initial rotation of the steering shaft 68 in either direction drives the valve actuator 114 to move radially relative to the valve body 90 until one of the actuator pins opens the associated valve. Hence, counterclockwise rotation of the steering shaft 68 drives the actuator pin 168 to the position illustrated in FIG. 8 to open the supply valve 102. Pressurized fluid from the first chamber 54 in the steering cylinder 52 and the pump 40 flows through the high pressure port 84 of the helm casing, through the supply passage 148, through the open supply valve 102, and into the control chamber 100. Fluid in the control chamber 100 then flows through the metering device 92 and into the second chamber 56 of the steering cylinder 32, thereby driving the piston 52 of the steering cylinder 32 to move to the right as illustrated in FIG. 8. Fluid flow through the metering device 92 drives the metering gear 202 to rotate, thereby driving the valve body 90 to rotate counterclockwise. When the operator stops turning the steering shaft 68, the metering element 202 of the metering body 90 relative to the valve actuator 114 until the supply valve 102 is reseated to terminate fluid flow through the metering device 92 from the control chamber and, accordingly, to terminate steering cylinder piston movement.

Figure 9:
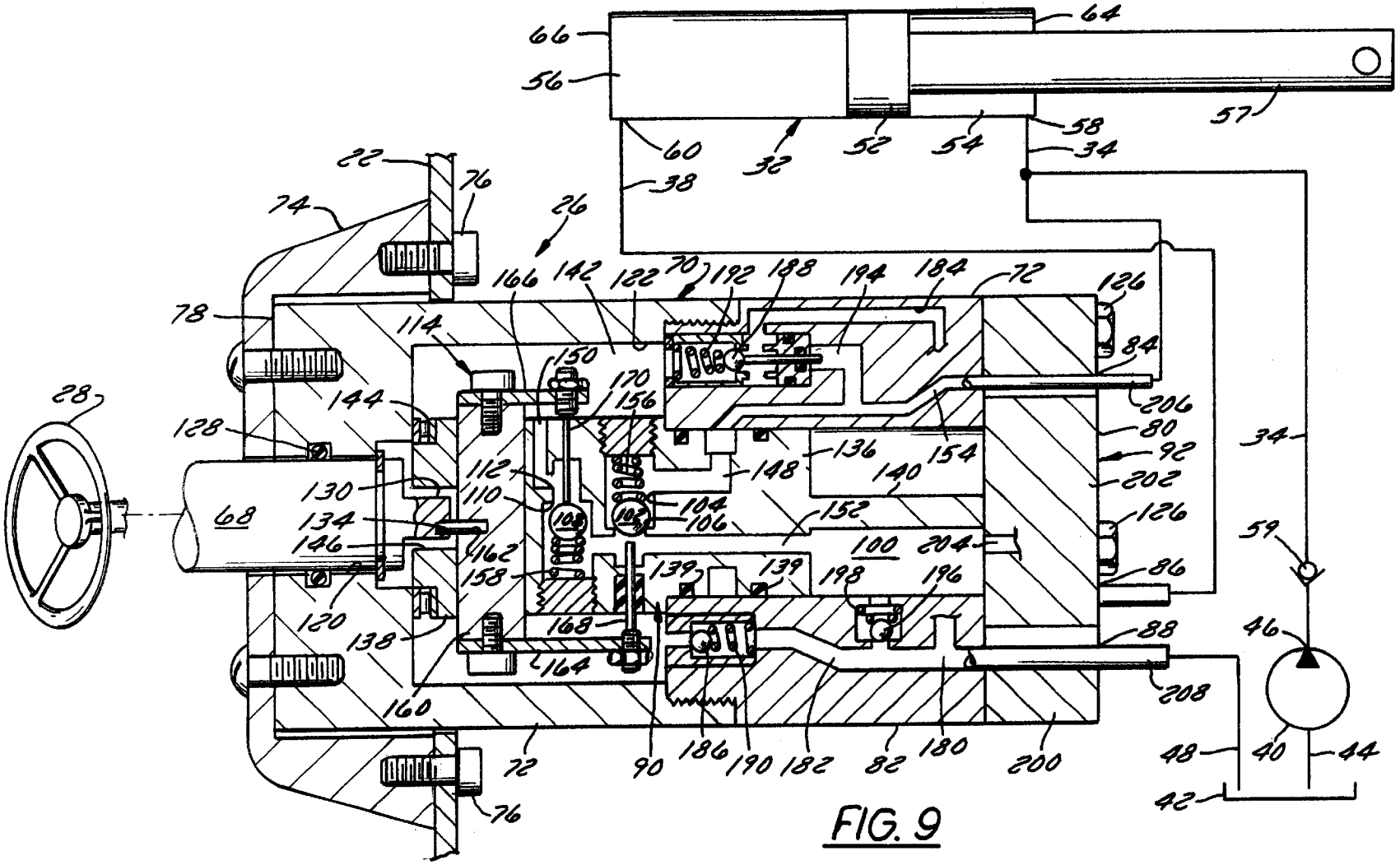
FIG. 9 corresponds to FIG. 5 and illustrates the system in a third operational state thereof.

Conversely, when the steering shaft 68 is rotated clockwise, the valve actuator pin 170 opens the return valve 108 as seen in FIG. 9. Fluid is therefore free to flow from the second chamber 56 of the steering cylinder 32, through the metering port 86 of the helm casing 70, through the metering device 92, through the control chamber 100, through the return valve 108, and into the vent chamber 142. Because the pilot operated valve 188 is open at this time under pilot pressure in the supply passage branch 194, fluid in the vent chamber 142 is free to flow through the valve 188 and the second branch 184 of the vent passage, out of the return port 88, and to the reservoir 42. The pressure differential across the piston 52 resulting from fluid flow from the second chamber 56 in the steering cylinder 32 drives the steering piston 52 to the left at this time to alter the steering angle of the watercraft. Fluid flow through the metering device 92 under these conditions also drives the metering element 202 to drive the valve body 90 to rotate the valve body in the same direction as the steering shaft 68, i.e., clockwise. When steering shaft rotation ceases, the metering element 202 will continue to rotate for a brief period of time until the valve body 90 moves relative to the actuator 114 sufficiently to reseat the return valve 108. At this time, fluid flow out of the second chamber 56 of the steering cylinder 32 terminates, arresting further movement of the steering piston 52.

In the event of pressure source failure, the relief valve assembly operates to permit the helm 26 to be operated manually. Specifically, if the steering shaft 68 is rotated clockwise under these conditions, the actuator pin 170 will open the return valve 108 as discussed above. Continued steering shaft rotation will cause the rectangular protrusion 130 on the end of the steering shaft 68 to contact the periphery of the opening 146 in the rear end cap 138, at which point the steering shaft 68 will drive the valve body 90 to rotate. The valve body will, in turn, drive the metering element 202 to rotate. The metering device 92 now acts as a pump and draws fluid out of the second chamber 56 of the steering cylinder 32 and into the control chamber 100. Fluid in the control chamber 100 then flows through the return valve 108 and into the vent chamber 142. However, because the inlet passage 154 is now unpressurized, the valve 188 is closed, and fluid flow out of the vent chamber 142 is blocked until the pressure therein rises to a level that sufficiently high to unseat the relief valve 186. When the fluid pressure in the vent chamber 142 reaches this level, the supply valve 102 also opens to allow fluid flow past the supply valve 102, backwards through the supply passage 148, out of the high pressure port 84, and into the first chamber 54 of the steering cylinder 32. The resultant pressure differential across the piston 52 drives the piston to the left. Because of the volume differential between the first and second chambers 54 and 56 of the steering cylinder 32, and because the volume of the second chamber 56 is larger than the volume of the first chamber 54, the first chamber 54 is incapable of receiving all of the fluid flowing out of the second chamber 56. The excess fluid instead flows past the relief valve 186 and back to the reservoir 42 through the drain passage 180.

Conversely, if the pump 40 fails and the steering shaft 68 is rotated counterclockwise, steering shaft rotation serves to first open the supply valve 102 and then drive the valve body 90 to rotate counterclockwise to drive the metering element 202 to rotate counterclockwise. Counterclockwise rotation of the metering element 202 pumps fluid from the control chamber 100 to the second chamber 56 of the steering cylinder 32. Simultaneously, fluid will be forced out of the first chamber 54 of the steering cylinder 32, through the high pressure port 84, the inlet and supply passages 154 and 148, the open supply valve 102, and into the control chamber 100. The resulting pressure differential drives the steering cylinder piston 52 to the right to effect a steering operation in the opposite direction. Because volume of the first chamber 54 of the steering cylinder 32 is smaller than the volume of the second chamber 56, a negative pressure is generated in the control chamber 100 during this process. That negative pressure lifts the valve 196 off its seat to permit make-up fluid to be drawn into the control chamber 100 from the reservoir 42, the drain passage 180, and the make-up passage 198.

Many changes and modifications could be made to the invention without departing from the spirit thereof. Some of these changes are discussed above. Other changes will become apparent from the appended claims.

I claim:

1. A power steering assist system for a watercraft, comprising:

(A) a hydraulically actuated steering cylinder assembly that is configured for connection to a steered mechanism of the watercraft, said steering cylinder assembly including (1) a steering cylinder, (2) a steering piston that is mounted in said steering cylinder to define first and second chambers on opposite sides thereof, and (3) a rod that is affixed to said steering piston, wherein one of said rod and said steering cylinder is movable relative to the other and is configured for connection to the steered mechanism;

(B) a fluid pressure source that has an outlet fluidically coupled to said first chamber in said steering cylinder; and (C) an operator-controlled helm that is spaced from said steering cylinder assembly and that has high pressure, return, and metering ports formed therein, said high pressure port being coupled to said fluid pressure source, said return port being coupled to a reservoir, and said metering port being coupled to said second chamber of said steering cylinder, wherein said helm includes (1) a metering element having at least first and second ports, said second port being coupled to said metering port in said helm; and (2) a control valve assembly that is coupled to said metering element and that is switchable between at least first and second states to alternatively couple said first port in said metering element to said high pressure and return ports of said helm, respectively, thereby alternatively permitting pressurized fluid to flow into said metering port from said metering element and from said metering port into said metering element.

2. The power steering assist system as recited in claim 1, wherein said control valve assembly is switchable to a third, neutral state in which said first port of said metering element is isolated from both of said high pressure and return ports.

3. The power steering assist system as recited in claim 2, wherein said helm further comprises an operator-manipulatable steering mechanism, and wherein said control valve assembly comprises first and second two-way/two-position valves that are configured to be actuated by said steering mechanism such that 1) both said first and second valves remain closed when said steering mechanism remains stationary, 2) movement of said steering mechanism in a first direction opens said first valve while leaving said second valve closed, and 3) movement of said steering mechanism in a second direction opens said second valve while leaving said first valve closed.

4. The power steering assist system as recited in claim 3, wherein said control valve assembly comprises a valve actuator and a valve body, said valve body 1) being rotatably coupled to said metering element and to said steering mechanism, 2) housing said first and second valves, 3) having a first passage formed therein that couples said high pressure port to said first port of said metering element, and 4) having a second passage formed therein that couples said first port of said metering element to said return port, said valve actuator being movable relative to said valve body between first, second, and third positions thereof corresponding to said first, second, and third states of said valve assembly.

5. The power steering assist system as recited in claim 4, wherein said steering mechanism comprises a steering wheel that is coupled to said valve body so as to cause said valve body to rotate during steering wheel rotation.

6. The power steering assist system as recited in claim 1, further comprising a relief valve assembly that allows the system to be operated manually in the event of pressure source failure.

7. The power steering assist system as recited in claim 6, wherein said relief valve assembly includes a two-way/two-position pilot-operated valve that allows manual operation of the system if said pressure source is inoperative.

8. The power steering assist system as recited in claim 6, wherein said metering element is coupled to said control valve assembly such that said metering element is rotated manually by said control valve assembly so as to act as a pump in the event of pressure source failure.

9. The power steering assist system as recited in claim 1, wherein said high pressure, return, and metering ports in said helm are all formed in an axial end of said helm.

10. The power steering assist system as recited in claim 1, wherein said steering cylinder of said steering cylinder assembly is stationary and said rod of said steering cylinder assembly is configured for connection to the steered mechanism.

11. A power steering assist system for a boat, comprising:

(A) a hydraulically actuated, unbalanced steering cylinder assembly that is configured for connection to a steered mechanism of the boat, said steering cylinder assembly including (1) a stationary steering cylinder that has a rod end and a cylinder end, (2) a steering piston that is slidably mounted in said steering cylinder to define first and second chambers on opposite sides thereof, wherein fluid pressures in said first and second chambers act on first and second different effective areas of said steering piston, and (3) a rod that is affixed to said steering piston, that extends axially through said rod end of said steering cylinder but not through said cylinder end, and that is configured for connection to the steered mechanism;

(B) a pump that has an inlet and an outlet fluidically coupled to said first chamber in said steering cylinder;

(C) a reservoir that is connected to said pump inlet; and (D) a helm that is spaced from said steering cylinder assembly and that includes (1) a steering shaft;

(2) a helm casing configured for mounting through a dash of the boat and having high pressure, return, and metering ports formed therein, said high pressure port being coupled to said pump, said return port being coupled to said reservoir, said metering port being coupled to said second chamber of said steering cylinder, (3) a metering element which is rotatably mounted in said helm casing and which has at least first and second ports, said second port being coupled to said metering port in said helm, and (4) a control valve assembly including a) a valve body that is rotatably mounted in said helm casing, that is coupled to said metering element so as to rotate therewith, and that is rotatably coupled to said steering shaft, wherein said valve body has a first passage formed therein that couples said high pressure port to said first port in said metering element and a second passage formed therein that couples said return port to said first port in said metering element, and b) first and second two-way/two-position valves located in said first and second passages, wherein said control valve assembly is coupled to said steering shaft such that both said first and second valves remain closed when the steering shaft is in a stationary position, 2) movement of said steering shaft in a first direction from the stationary position opens said first valve while leaving said second valve closed, and 3) movement of said steering shaft in a second direction from the stationary position opens said second valve while leaving said first valve closed.

12. The power steering assist system as recited in claim 11, wherein said valve assembly further comprises a pilot actuated valve that allows manual operation of the system if said pressure source is inoperative.

13. In combination:

(A) a hydraulically actuated steering cylinder assembly that is configured for connection to a steered mechanism of a watercraft, said steering cylinder assembly including a steering cylinder having a chamber formed therein;

(B) a fluid pressure source that has an outlet fluidically coupled to said chamber in said steering cylinder; and (C) a helm assembly that is located remote from said steering cylinder assembly and that includes (1) a helm casing that is configured to extend through a dash of the watercraft, said helm casing having front and rear axial ends and housing a metering element and a valve body;

(2) a steering shaft that extends axially toward said rear axial end of said helm casing from outside of said helm casing; and (3) a plurality of ports on said helm casing for fluidically coupling said helm casing to other hydraulic components of the combination so as to effect power steering of the system, said ports including a high pressure port in fluid communication with a) said outlet of said pressure source and b) said chamber in said steering cylinder.

14. The combination as recited in claim 13, wherein said ports consist of said high pressure port, a return port, and a metering port.

15. The combination as recited in claim 13, wherein said helm casing has a diameter of no more than about 3¼".

16. The combination as recited in claim 13, wherein said helm casing has an axial length of no more than about 7".

17. A method of steering a watercraft, comprising:

(A) placing a pressure source in fluid communication with a high pressure port of a helm casing of a helm and a first chamber in a hydraulic steering cylinder located remote from said helm casing, said first chamber being separated from a second chamber by a steering piston, a driven member being formed by one of said steering cylinder and said piston and being coupled to a steered mechanism of the watercraft;

(B) in response to movement of a steering mechanism of the watercraft in a first direction from an at-rest position thereof, causing-a metering element in said helm casing to rotate in a first direction and deliver fluid to said second chamber in said steering cylinder, thereby causing said driven member to move in a first direction; and (C) in response to movement of the steering mechanism in a second direction from the at-rest position, causing said metering element to rotate in a second direction to permit hydraulic fluid to flow into metering element from said second chamber in said steering cylinder, thereby causing said driven member to move in a second direction opposite said first direction.

18. The method as recited in claim 17, wherein, said metering element has a first port and has a second port in fluid communication with said second chamber in said steering cylinder, when said steering mechanism is in said at-rest position, a control valve assembly of said helm is switched to a first state isolating said first port of said metering element from said pressure source and from vent, when said steering mechanism moves in said first direction from said at-rest position, said control valve assembly switches to a second state fluidically coupling said first port in said metering element to said pressure source, and wherein when said steering mechanism moves in said second direction, said valve assembly switches to a third position fluidically coupling said first port in said metering element to vent.

19. The method as recited in claim 18, wherein rotation of the steering mechanism results in rotational movement of a valve body in said helm casing between first, second, and third positions thereof.

20. The method as recited in claim 18, wherein, when steering mechanism movement in either said first or second direction ceases, said metering element continues to rotate to drive said valve body to rotate in the corresponding direction until the corresponding one of said first and second valves closes, thereby cutting off fluid flow to or from said first port in said metering element and terminating metering element rotation.

21. The method as recited in claim 18, wherein, upon failure of said pressure source, movement of said steering mechanism drives said metering element to pump fluid to or from said steering cylinder to effect a manual steering operation.

22. A method of steering a watercraft, comprising:

(A) placing a pressure source in fluid communication with a high pressure port of a helm casing of a helm and a first chamber in an unbalanced hydraulic steering cylinder located remote from said helm casing, said first chamber being separated from a second chamber by a steering piston, fluid pressures in said first and second chambers acting on first and second different effective areas of said steering piston, and a driven member being formed by one of said steering cylinder and said piston and being coupled to a steered mechanism of the watercraft;

(B) rotating a steering shaft in a first direction to drive a valve actuator in said helm casing to move from a position in which supply and return valves mounted in a valve body in said helm casing are closed to a position in which said supply valve is open and said return valve is closed, thereby causing a metering element in said helm casing to rotate in a first direction and deliver fluid to said second chamber in said steering cylinder, hence causing said driven member to move in a first direction;

(C) terminating rotation of said steering shaft, whereupon continued rotation of said metering element drives said valve body to rotate to a position closing said supply valve, thereby cutting off fluid flow through said metering element and terminating driven member movement;

(D) rotating said steering shaft in a second direction to drive said valve actuator to move from a position in which said supply and return valves are closed to a position in which said return valve is open and said supply valve is closed, thereby causing fluid to flow through said metering element from said second chamber in said steering cylinder, hence causing said driven member to move in a second direction; and (E) terminating rotation of said steering shaft, whereupon continued rotation of said metering element drives said valve body to rotate to a position closing said return valve, thereby cutting off fluid flow through said metering element and terminating driven member movement.

* * * * *